US010882668B2

(12) United States Patent
D'Amato

(10) Patent No.: US 10,882,668 B2
(45) Date of Patent: Jan. 5, 2021

(54) RECLOSABLE LID

(71) Applicant: SEDA INTERNATIONAL PACKAGING GROUP SPA, Naples (IT)

(72) Inventor: Gianfranco D'Amato, Arzano (IT)

(73) Assignee: Seda International Packaging Group SpA, Naples (IT)

( * ) Notice: Subject to any disclaimer, the term of this patent is extended or adjusted under 35 U.S.C. 154(b) by 0 days.

(21) Appl. No.: 15/036,686

(22) PCT Filed: Nov. 16, 2014

(86) PCT No.: PCT/IB2014/002456

§ 371 (c)(1),
(2) Date: May 13, 2016

(87) PCT Pub. No.: WO2015/071743

PCT Pub. Date: May 21, 2015

(65) Prior Publication Data

US 2016/0288963 A1 Oct. 6, 2016

(30) Foreign Application Priority Data

Nov. 16, 2013 (IT) ..... RM20130196 U

(51) Int. Cl.
*B65D 47/08* (2006.01)
*B65D 43/02* (2006.01)

(52) U.S. Cl.
CPC ..... *B65D 47/0847* (2013.01); *B65D 43/0212* (2013.01); *B65D 2543/00046* (2013.01); *B65D 2543/00092* (2013.01); *B65D 2543/00296* (2013.01)

(58) Field of Classification Search
CPC ..... B65D 23/12; B65D 23/16; B65D 47/0847
USPC ..... 220/254.3, 254.7, 254.1, 254.4
See application file for complete search history.

(56) References Cited

U.S. PATENT DOCUMENTS 4,022,352 A * 5/1977 Pehr ..... B65D 47/0838 222/153.14
4,899,902 A * 2/1990 DeMars ..... B65D 43/0212 220/254.3
5,395,015 A * 3/1995 Bolen, Jr. ..... B65D 47/0885 215/235
5,865,354 A * 2/1999 Bansal ..... B65D 47/0847 215/224
2003/0089714 A1 5/2003 Dart

FOREIGN PATENT DOCUMENTS

WO 2006/039044 A2 4/2006

OTHER PUBLICATIONS

International Search Report for PCT/IB2014/002456, dated Mar. 16, 2015. 2 pages.

* cited by examiner

*Primary Examiner* — Jeffrey R Allen
(74) *Attorney, Agent, or Firm* — Fish & Richardson P.C.

(57) ABSTRACT

The present invention provides a reclosable lid for a cup or beaker for beverage, the lid comprising an edge region adapted to provide the coupling with a respective edge of said cup or beaker, and a dispensing port of the beverage contained within of said cup or beaker, the lid is characterized in that it comprises a further upper region connected from the edge region and where closing means for closing said dispensing port and supporting means for supporting said closing means are formed.

6 Claims, 3 Drawing Sheets

RECLOSABLE LID

CROSS REFERENCE TO RELATED APPLICATIONS

This is a U.S. national phase application under U.S.C. § 371 of International Patent Application No. PCT/IB2014/002456, filed Nov. 16, 2014 which claims the benefit of Italian Application No. RM2013U000196, filed Nov. 16, 2013. The International Application was published in English on May 21, 2015 as International Publication No. WO/2015/071743 A1 under PCT Article 21(3). The contents of the above applications are incorporated herein in their entirety.

The present invention relates to a lid and, more precisely, to a reclosable lid for a cup or beaker for beverages of the type suitable for the take-away and the subsequent consumption of the beverage.

PRIOR ART

Up today different types of lids for cups or beakers for soft drinks or the like are widely used, and typically for the use in "fast food" where it is provided the take-away of the beverage within said cups for the subsequent consume of the beverage.

For example, in the case of hot beverages such as coffee or tea there is provided the use of a first type of lids which in addition to ensuring a sealed coupling with the edge of the cup, they have a small dispensing port above the lid where the consumer can put his own lips and slowly sip the beverage without causing spills. This functional solution, although very practical and simple has the drawback of not preventing any leakage of the beverage in the event of overturning of the cup.

Alternatively, there have been proposed on the market different types of reclosable lids, which allow the closing of the upper dispensing port after the user sip the beverage or during the transporting of the cup. With this aim, there may be provided different arrangements.

According to a first embodiment, there is provided a movable closing member connected to the lid and which is used by inserting it in the dispensing port, so obtaining the closing of the same. Alternatively to this embodiment, a different solution it is proposed and foresees that the lid be made by two members arranged one above the other, and that the closing of the dispensing port be obtained by rotation of the first member with respect to the second member.

All these constructive solutions discretely solve in a satisfactory manner the problem of being able to close the dispensing port of the lid during the transporting or non-use of the cup.

Object of the present invention is to provide an improved lid for cups or beakers which guarantees seal against spillage at the coupling area between the edge of the cup and the lid and, at the same time, ensuring an improved sealing at the dispensing port.

Another object of the present invention is to provide an improved lid for cups or beakers for the containing of hot drinks at "Fast Food" selling points, and ensuring a good seal against spillage of the beverage through the dispensing port and in case of overturning of the cup.

A further object of the present invention is to provide a lid for cups or beakers which be reclosable with high sealing reliability against spillage and at the same time that it is easy to make, effective, and low cost.

BRIEF DESCRIPTION OF THE INVENTION

The present invention provides a reclosable lid for cups or beakers, which comprises an edge region adapted to provide the coupling with a respective edge of a cup or beaker, a dispensing port formed integrally at the top of the lid, and a closure member of said dispensing port integrally formed at the top wall of the lid, the closure member being mounted in order to oscillate between a first closed condition, wherein it is inserted into the dispensing opening of the lid, and a second opened condition where the dispensing port it is opened, and wherein the closure member it is rotated by 180° from its first condition and it is locked onto a locking member integral to said lid.

Thus, the present invention provides a reclosable lid for cups or beakers substantially according to the appended claims.

DETAILED DESCRIPTION OF THE INVENTION

A detailed description of a preferred embodiment of the reclosable lid for cups or beakers of the present invention will now be given, given by way of a non limiting example and with reference to the appended drawings, wherein.

Figure 1:
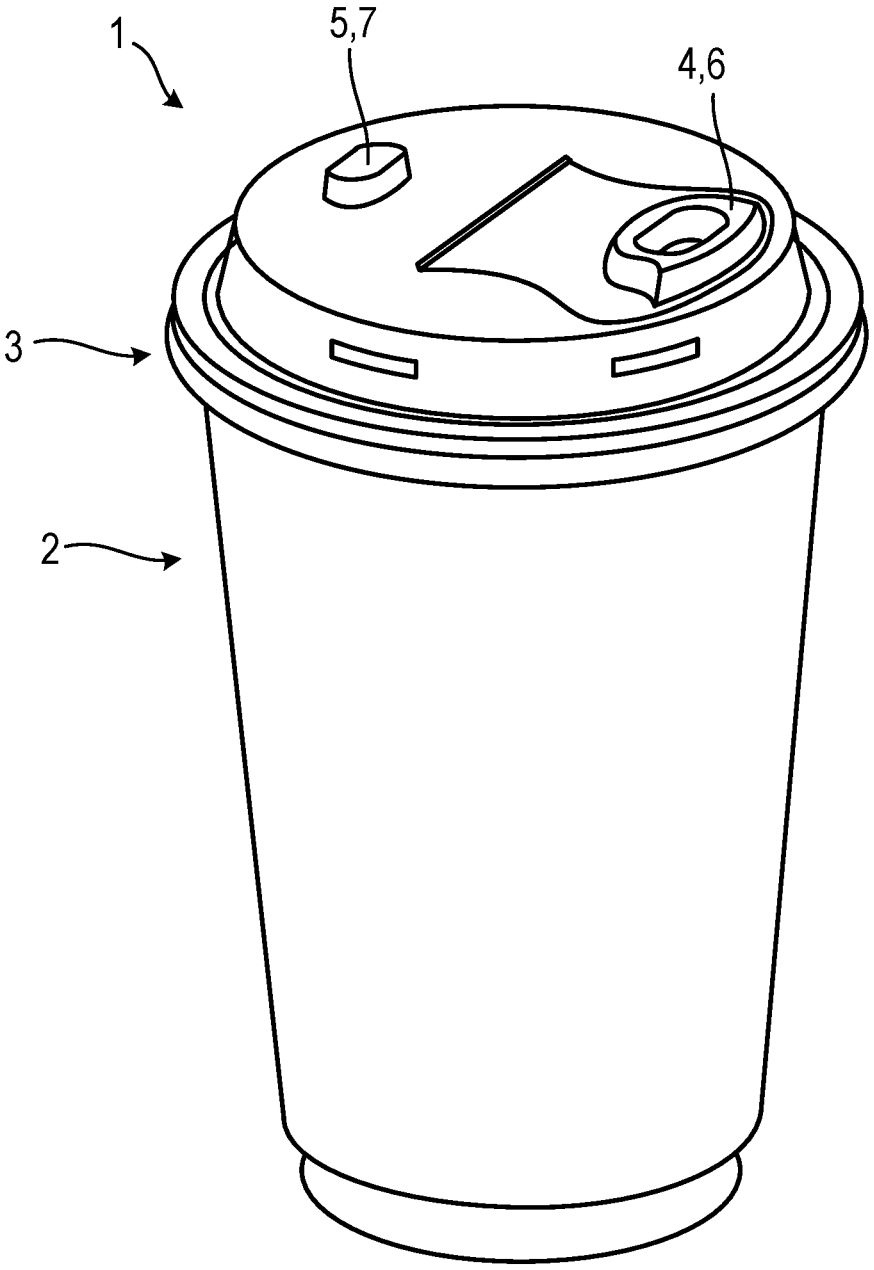
FIG. 1 is a front perspective view from above of the lid of the present invention when coupled with a beaker.

With reference now to FIG. 1, therein is illustrated the lid 1 of the present invention coupled to a paper material beaker. According to the present invention, there is provided a reclosable lid 1 for cups 2 or beakers, which comprises an edge region 3 adapted to provide the coupling with a respective edge 12 of a cup 2 or beaker.

Above the edge region 3, the lid 1 has a pair of protruding members 4, 5 each arranged diametrically opposite to the other, a first protruding member 4 consisting of a closure member 6, while the second protruding member 5 being a supporting member 7 of the closure member 6. As will be better illustrated hereinafter, the closure member 6 has a hollow shape and it is mounted in an oscillating manner with respect to the top of the lid 1.

Figure 2:
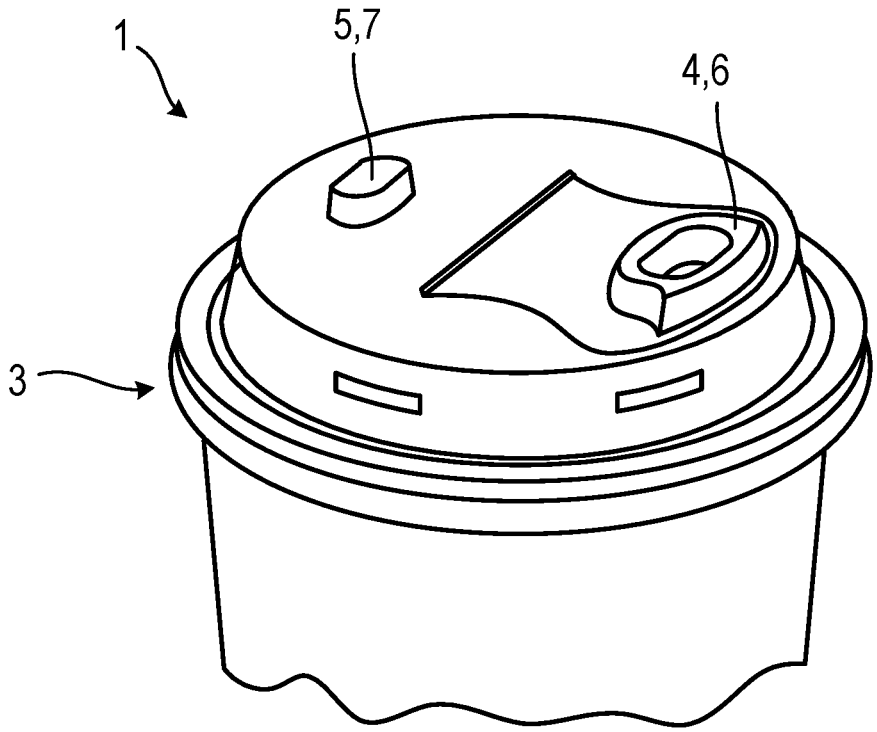
FIG. 2 is a front perspective view and from above of the lid of FIG. 1 in the closed condition.
Figure 3:
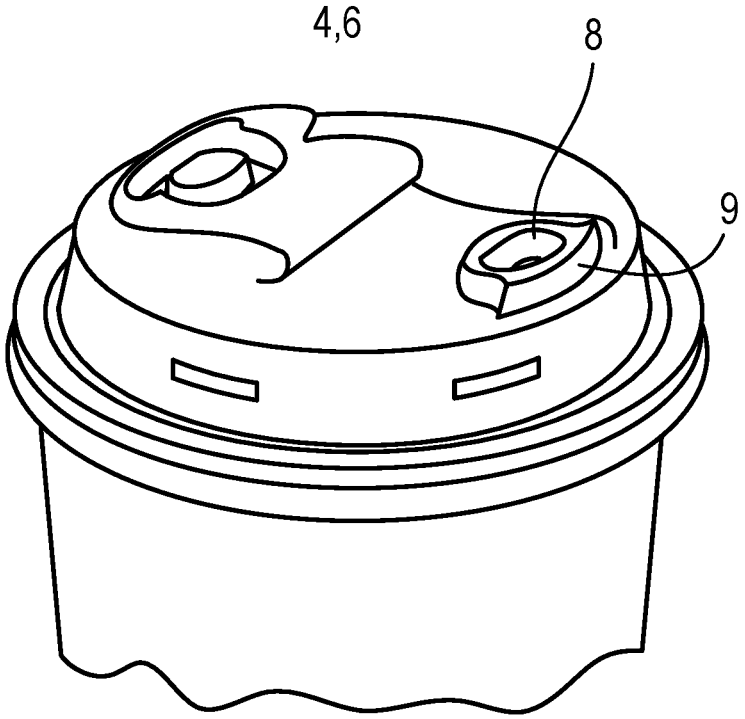
FIG. 3 is a front perspective view and from above of the lid of FIG. 1 in the opened condition.

With particular reference now to FIGS. 2 and 3, the closure member 6 for a dispensing port 8 of the lid 1 has a hollow shape and projects from a plane of the lid.

With particular reference to FIG. 3, there is illustrated therein the reclosable lid 1 in an opened operating condition, wherein the closure member 6 of the dispensing port 8 it is in a rotated condition by 180° with respect to the closed condition. According to this embodiment and as it is apparent from the drawing, the beverage dispensing port 8 of the lid has a further projecting member 9 that is protruding from a second lid body 10 which it is arranged below a first lid body 11 (better illustrated below).

Figure 4:
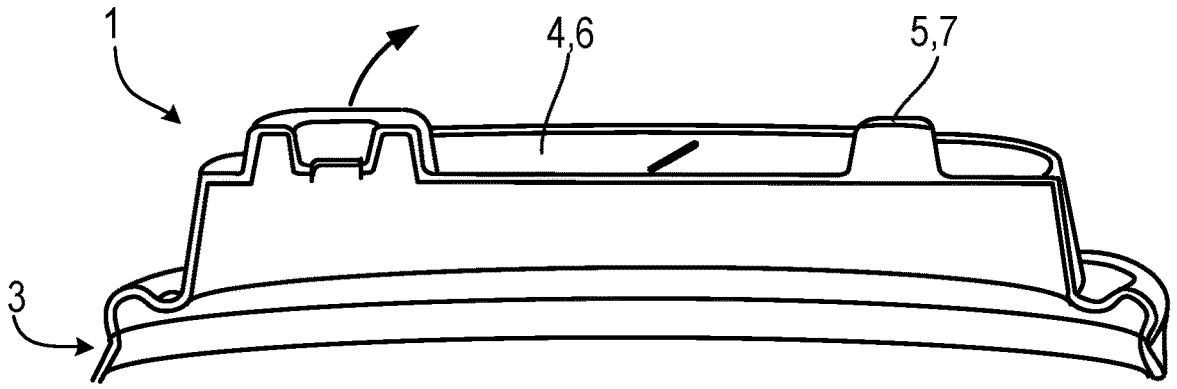
FIG. 4 is a perspective view and in a longitudinal section of the lid of the present invention in the closed condition.

With reference now to FIG. 4, the lid 1 of the present invention is shown in a longitudinal cross section and in the closed condition. The lid is formed by said two lid bodies 10, 11, wherein the first lid body 11 is inserted inside the second lid body 10. In this condition, the closure member 6 is inserted over a second projecting member 9 integral to the second lid body 10 and which comprises the dispensing port 8 of the lid 1.

Figure 5:
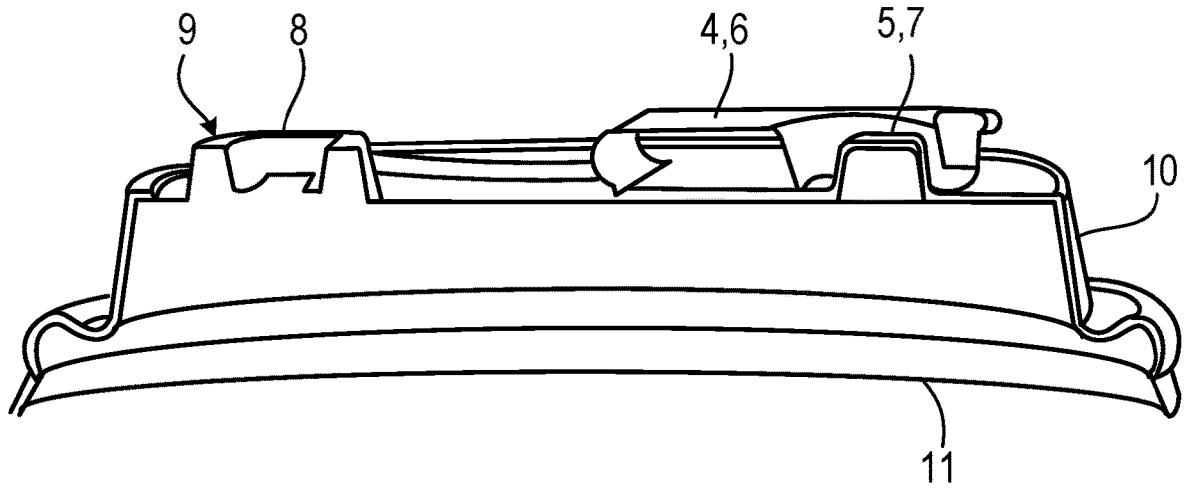
FIG. 5 is a perspective view and in longitudinal section of the lid of the present invention in the opened condition.

According to FIG. 5, the lid 1 is in its fully opened condition, wherein the dispensing port 8 is free of any closure, and wherein the closure member 6 is completely rotated by 180° onto the second lid body 10. In this condition, the closure member 6 is folded onto the respective supporting member integrally formed onto the second lid body and at the opposite side of the closure member 6.

As it is evident, the closure member 6 of the lid 1 is hollow and is adapted to be folded onto the dispensing port of the lid, and also it is adapted to be mounted in a removable manner onto the second supporting member which is integrally projecting from to the second body lid and formed at a diametrically opposite part from the closure member.

The invention claimed is:

1. A reclosable lid for a cup or beverage beaker, the lid comprising an edge region adapted to provide coupling with a respective edge of said cup or beaker and an upper region connected to the edge region, wherein the lid is formed by a first lid body that is inserted inside a second lid body, each lid body comprising a top wall, said first lid body comprising a first protruding member with a dispensing port on said top wall of said first lid body and said second lid body comprising a closing means and second protruding member as a supporting member for a closure member both part of the top wall of the second lid body, wherein the closure member is mounted in a rotatable manner with respect to the top of the lid for closing the dispensing port and is supported by the second protruding member in its open condition, wherein the first protruding member protrudes through an opening in the top wall of the second lid body which is opened by the closure member in its open position, and wherein first and second protruding members are formed diametrically opposite at the top of the lid.

2. Reclosable lid according to claim 1, wherein said closure member comprises a projecting member integrally formed in the upper region of the second lid body.

3. Reclosable lid according to claim 1, wherein the first protruding member, is realized by folding of said closing member onto said second protruding member.

4. Reclosable lid according to claim 1, wherein when the reclosable lid is in its opened condition, said closing means is in a rotated condition by 180° with respect to a closed condition.

5. Reclosable lid according to claim 3 wherein, when the lid is in the fully open condition, the dispensing port is free of any closure, and the closing means is fully rotated by 180° onto the second lid body, and folded onto said first protruding member of said supporting member, said first protruding member being integrally formed onto the second lid body opposite to the dispensing port.

6. Reclosable lid according to claim 3, wherein the closing means has a hollow part adapted to be folded onto the dispensing port of the lid, and further adapted to be folded in a removable manner onto said first protruding member formed integrally in the second lid body, and diametrically opposite with respect to the dispensing port.

* * * * *